US005603230A

United States Patent [19]

Tsai

[11] Patent Number: 5,603,230

[45] Date of Patent: Feb. 18, 1997

[54] WATER SUPPLY DEVICE FOR A REFRIGERATOR DOOR

[76] Inventor: Te-wan Tsai, No. 493, Szute Rd., Wufeng Hsiang, Taichung Hsien, Taiwan

[21] Appl. No.: 634,236

[22] Filed: Apr. 18, 1996

[51] Int. Cl.[6] ..... B67D 5/62; F25D 23/12

[52] U.S. Cl. ..... 62/390; 62/331

[58] Field of Search ..... 62/389, 390, 391, 62/396, 440, 441, 331; 222/146.1

[56] References Cited

U.S. PATENT DOCUMENTS

| | | | |
|---|---|---|---|
| 2,126,491 | 8/1938 | McCartha | 62/396 |
| 2,408,704 | 10/1946 | Taylor | 62/389 |
| 2,504,622 | 4/1950 | Band et al. | 62/391 |
| 2,512,395 | 6/1950 | Sundberg | 62/391 |
| 4,007,856 | 2/1977 | Murphy et al. | 222/67 |
| 4,880,535 | 11/1989 | Burrows | 210/181 |

*Primary Examiner*—William Doerrler

*Attorney, Agent, or Firm*—Morton J. Rosenberg; David I. Klein

[57] ABSTRACT

A water supply device disposed in a refrigerator door includes a first tank, a second tank and a third tank respectively disposed in the door, each of the three tanks having a pipe extending therefrom and each pipe having an outlet extending from an outer layer of the door, a first connecting pipe with a first one-way valve disposed thereto being connected between the first and the second tank, a second connecting pipe with a second one-way valve disposed thereto being connected between the second and the third tank, the first tank having a heating device disposed therein and only the first and the second tank being separated from an interior of the refrigerator by an insulating layer.

1 Claim, 5 Drawing Sheets

WATER SUPPLY DEVICE FOR A REFRIGERATOR DOOR

FIELD OF THE INVENTION

The present invention relates to a water supply device and more particularly to a water supply device disposed in a refrigerator door, wherein the water supply device provides hot, warm and chilled water.

BRIEF DESCRIPTION OF THE PRIOR ART

Conventionally, people fill water in a pot and put the pot in a refrigerator in order to have chilled water to be drunk and people boil water by an electric cooker or gas cooker to get hot water. Every time one wants to drink chilled water, he/she has to open the refrigerator door, this action results in a loss of low temperature of the refrigerator and thus increases an operation period of the compressor of the refrigerator. Although there is an autoboiler sold in the market, such an auto-boiler occupies space in a house.

SUMMARY OF THE INVENTION

The present invention intends to provide a water supply device disposed in a refrigerator door, the device has a hot water outlet, a warm water outlet and an chilled water outlet extending from the outer layer of the door so as to provide a convenient feature for users without opening the door so as to mitigate and/or obviate the above-mentioned problems.

The present invention provides a water supply device disposed in a refrigerator door and the device includes a first tank, a second tank and a third tank respectively disposed in the door, each of the three tanks having a pipe extending therefrom and each pipe having an outlet extending from an outer layer of the door. A first connecting pipe with a first one-way valve disposed thereto is connected between the first and the second tank, a second connecting pipe with a second one-way valve disposed thereto being connected between the second and the third tank. The first tank has a heating device disposed therein and only the first and the second tank are separated from an interior of the refrigerator by an insulation layer.

It is an object of the present invention to provide a water supply device disposed in the refrigerator door wherein the device provides hot, warm and chilled water.

It is another object of the present invention to provide a device in the refrigerator whereby a user can get water from the device without opening the refrigerator door.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
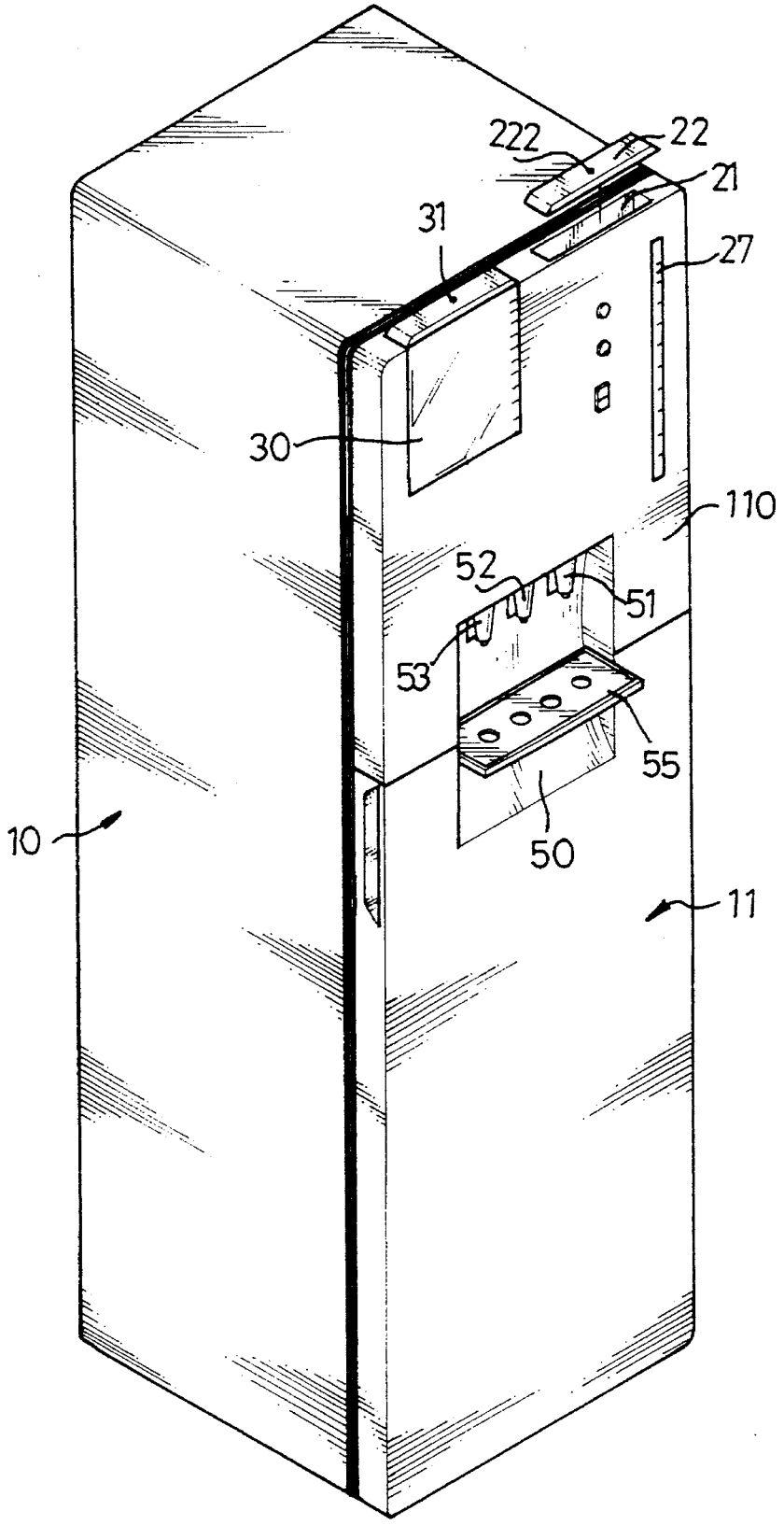
FIG. 1 is a perspective view of a refrigerator to which a water supply device in accordance with the present invention is disposed.
Figure 2:
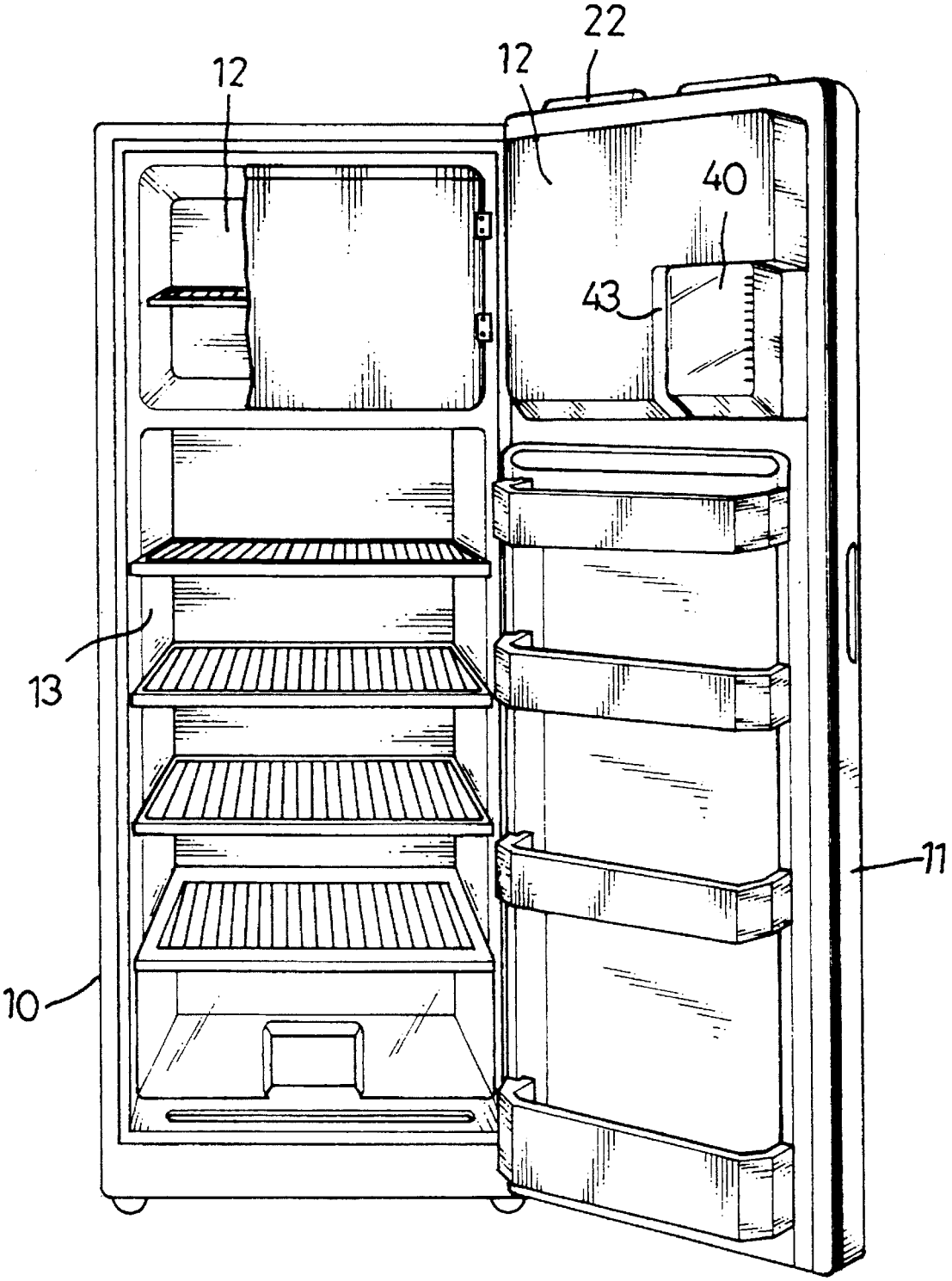
FIG. 2 is a perspective view of the refrigerator shown in FIG. 1 wherein a door of the refrigerator is opened.
Figure 3:
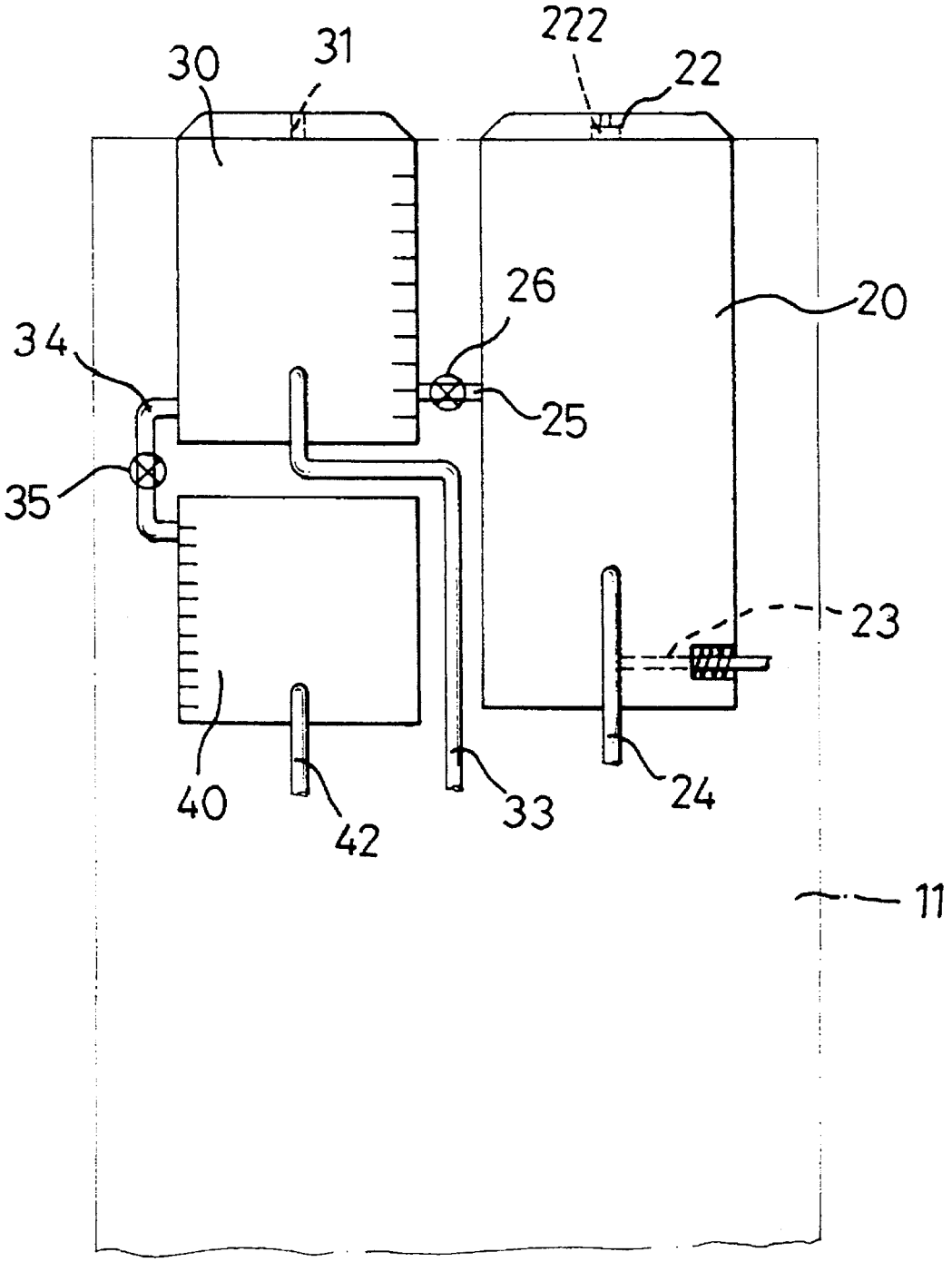
FIG. 3 is an illustrative view to show an arrangement of a first tank, a second tank and a third tank and the related pipes connected to these tanks.
Figure 4:
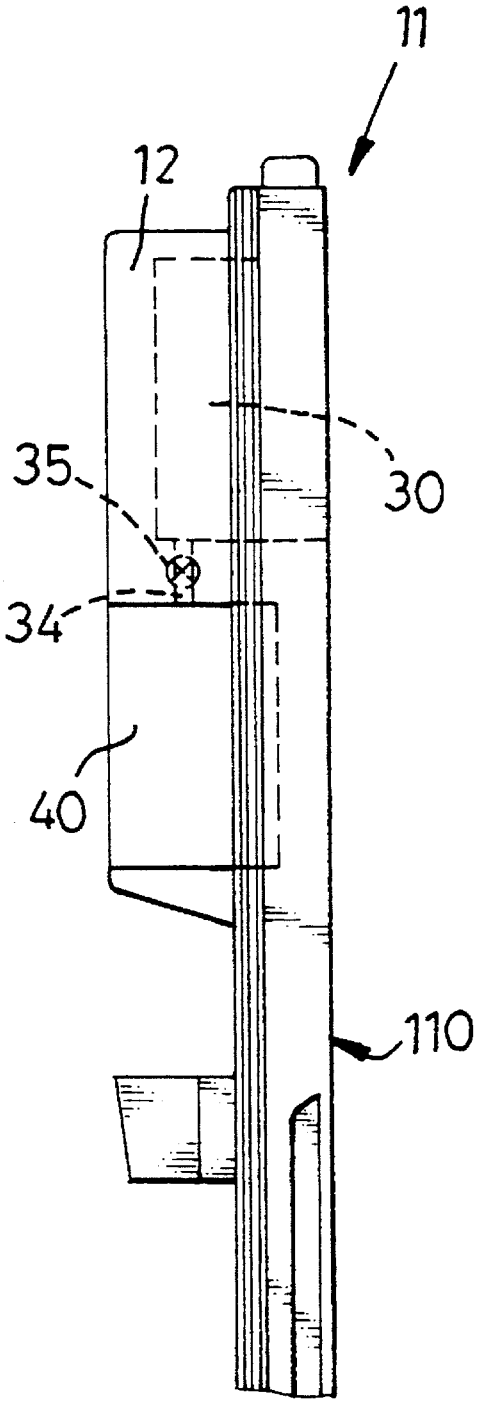
FIG. 4 is a side illustrative view to show the positions of the second and the third tank.

Referring to the drawings and initially to FIGS. 1 through 4, a refrigerator includes a body 10 and door 11, the body 10 comprising a freezer compartment 14 and a refrigerator compartment 13 and the door 11 comprising an outer layer 110 and an inner insulating layer 12 which is disposed corresponding to the freezer compartment 12. The device comprises a first tank 20 disposed in the door 11 and located between the outer layer 110 and the inner insulating layer 14, the first tank 20 having a first open top 21 communicating with a top of the door for a cap 22 to be mounted thereon to cover the first open top 21. A valve 222 is disposed in the cap 22 to avoid the pressure fin the first tank 20 from becoming too great. A first pipe 24 communicates by one end thereof with an interior of the first tank 20 and the other end of the first pipe 24 has a first outlet 51 disposed thereto. The first outlet 51 extends from a concave portion 50 defined in the outer layer 110 of the door 10 wherein a cup shelf is disposed in the concave portion 50. A heating means 23 is disposed in a lower portion of the first tank 20. The inner insulating layer 14 prevents high temperature produced by the heating means 23 from entering into the freezer compartment 12.

A second tank 30 is disposed in the door 11 and located between the outer layer 110 and the inner insulating layer 14 and further comprises a first connecting pipe 25 connected between the first tank 20 and the second tank 30, a first one-way valve 26 disposed in the first connecting pipe 25 such that water boiled in the first tank 20 can be operated to flow into the second tank 30 where it eventually cools to be luke warm water. A second pipe 33 has one end thereof communicating with an interior of the second tank 30 and the other end of the second pipe 33 has a second outlet 52 disposed thereto, the second outlet 52 extending from the concave portion 50 of the outer layer 110 of the door 11. A hole 31 is defined in a top of the second tank 30 to let excess heat be exhausted therefrom.

A third tank 40 is disposed in the door 11 wherein an inner side of the third tank 40 is not covered by the inner insulating layer 14 and there is space 43 defined between the third tank 40 and the inner insulating layer 14 such that the temperature of a liquid such as water in the third tank 40 is rapidly reduced by freezing air in the freezer compartment 12. A second connecting pipe 34 is connected between the second tank 30 and the third tank 40, a second one-way valve 35 disposed in the second connecting pipe 34 such that the warm water in the second tank 30 is operated to flow into the third tank 40 to become chilled water. A third pipe 42 has one end thereof communicating with an interior of the third tank 40 and the other end of the third pipe 42 has a third outlet 53 disposed thereto, the third outlet 53 extending from the concave portion 50 of the outer layer 110 of the door 11.

Accordingly, a user can selectably get water with different temperature he/she needs by operating one of the suitable outlets 51, 52, 53. Furthermore, a transparent scale 27 is disposed to the outer layer 110 of the door 11 to show. a water level in the first tank 20 and the outer layer 110 has a recess defined in the top thereof so as to let the second tank 30 in which is a transparent tank be received therein. Besides, the outer layer 110 is selectably disposed as a removable-layer in order to easily maintain the device.

Figure 5:
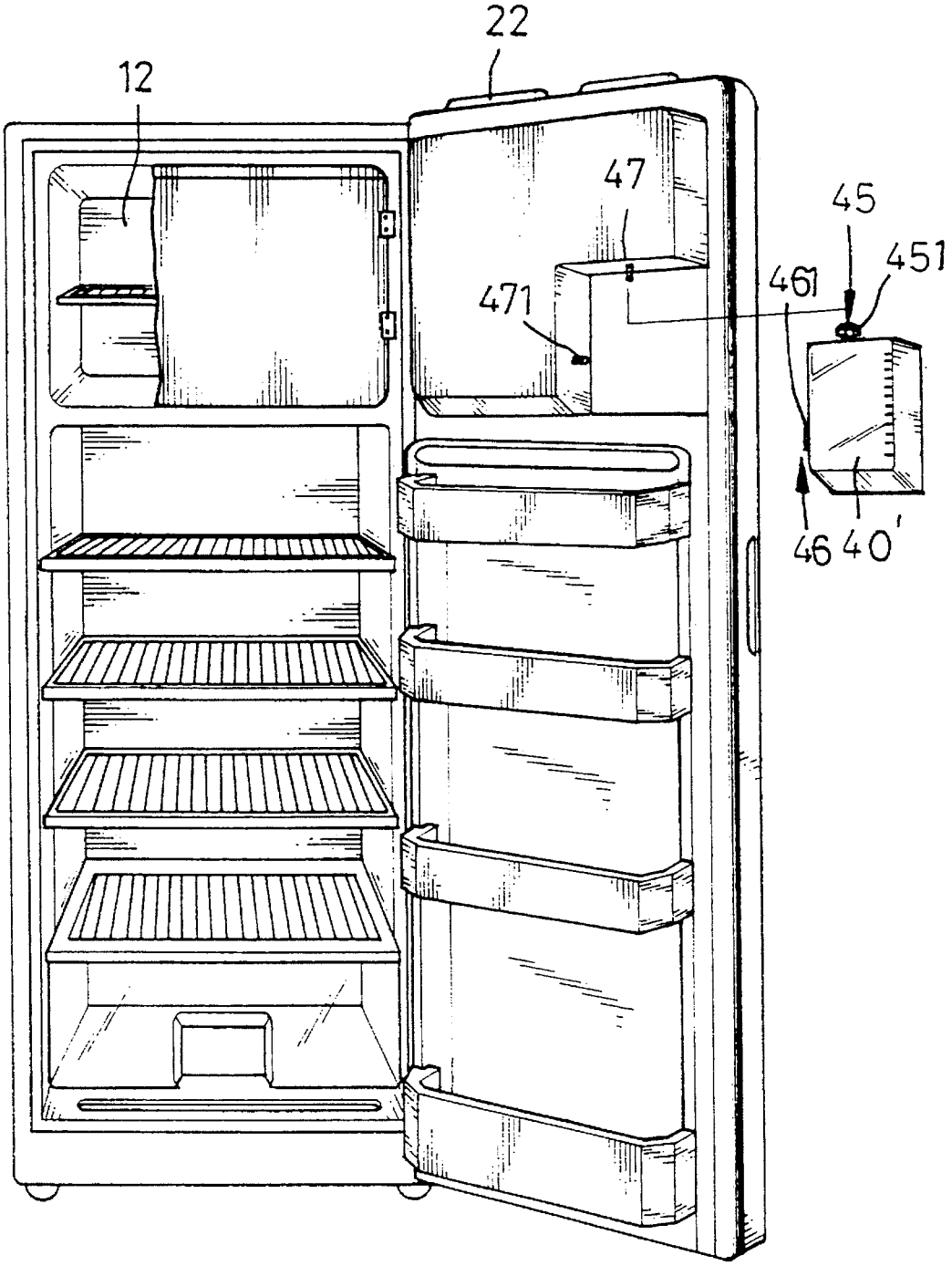
FIG. 5 is a view similar to that of FIG. 2 wherein the third tank is disengaged from the door.

Referring to FIG. 5 which shows another embodiment of the device wherein the third tank 40' has an upper connecting part 45 and a side connecting part 46, each of which has a nut 451/461 respectively and rotatably disposed thereto. The inner insulated layer 14 has two connecting heads 47, 471 extending from the inner insulated layer 14, each of the connecting studs 47, 471 disposed to a position corresponding to the upper connecting part 45 and the side connecting part 46 respectively so as to engage the third tank 40' to the door 11 by threadingly engaging the respective nut 451, 461 to the corresponding connecting head 47,471.

Although the invention has been explained in relation to its preferred embodiment, it is to be understood that many other possible modifications and variations can be made without departing from the spirit and scope of the invention as hereinafter claimed.

What is claimed is:

1. A water supply device disposed in a refrigerator door, said refrigerator comprising a body and a door, said body comprising a freezer compartment and a refrigerator compartment, said door having an outer layer and an inner insulating layer which is disposed corresponding to said freezer compartment, said device comprising:

a first tank disposed in said door and located between said outer layer and said inner insulating layer and having a first open top communicating with a top of said door for a cap mounted thereon and covering up said first open top, a first pipe having one end thereof extending from said first tank, said first pipe communicates with an interior of said first tank and the other end of said first pipe having a first outlet disposed thereto, said first outlet extending from said outer layer of said door, a heating means disposed in said first tank;

a second tank disposed in said door and located between said outer layer and said inner insulating layer, a first connecting pipe connected between said first tank and said second tank, a first one-way valve disposed in said first connecting pipe, a second pipe having one end thereof communicating with an interior of said second tank and the other end of said second pipe having a second outlet disposed thereto, said second outlet extending from said outer layer of said door;

a third tank disposed in said door wherein an inner side of said third tank is not covered by said inner insulating layer, a second connecting pipe connected between said second tank and said third tank, a second one-way valve disposed in said second connecting pipe, a third pipe having one end thereof communicating with an interior of said third tank and the other end of said third pipe having a third outlet disposed thereto, said third outlet extending from said outer layer of said door.

* * * * *